US006113093A

United States Patent [19]

Morinaga et al.

[11] Patent Number: 6,113,093

[45] Date of Patent: Sep. 5, 2000

[54] APPARATUS FOR DOCUMENT SETTING, FEEDING AND PROCESSING

[75] Inventors: Kazuyuki Morinaga; Keizo Sasai, both of Yokohama; Hiroshi Ogushi, Chiba-ken; Shigeyuki Sugiyama, Hiratsuka; Yoshiaki Suzuki, Yokohama, all of Japan

[73] Assignee: Canon Kabushiki Kaisha, Tokyo, Japan

[21] Appl. No.: 09/049,138

[22] Filed: Mar. 27, 1998

[30] Foreign Application Priority Data

Mar. 27, 1997 [JP] Japan ..... 9-074913

[51] Int. Cl.[7] ..... B65H 1/00

[52] U.S. Cl. ..... 271/162

[58] Field of Search ..... 271/162, 171; 399/114, 124, 125, 377; 359/498

[56] References Cited

U.S. PATENT DOCUMENTS 5,028,966 7/1991 Kozuka et al. ..... 355/260 X
5,238,235 8/1993 Nitta et al. ..... 271/9 X
5,274,477 12/1993 Mori et al. ..... 358/296 X
5,464,205 11/1995 Bang ..... 271/213 X
5,613,672 3/1997 Tanaka et al. ..... 271/162
5,796,028 8/1998 Toyomura et al. ..... 396/106 X
5,860,044 1/1999 Eki et al. ..... 399/125

*Primary Examiner*—Christopher P. Ellis
*Assistant Examiner*—Kenneth W Bower
*Attorney, Agent, or Firm*—Fitzpatrick, Cella, Harper & Scinto

[57] ABSTRACT

An apparatus for setting sheet materials having a sheet material setting member pivotably supported to a sheet material processing apparatus, an auxiliary member for enhancing a sheet material setting area, and a restricting member for restricting pivotal movement of the auxiliary member in a midway of the movement when the auxiliary member pivotally moves according to pivotal movement of the sheet material setting member. The auxiliary member pivotally moves in a reverse direction according to the pivotal movement of the sheet material setting member when it restricted by the restricting member.

13 Claims, 9 Drawing Sheets

APPARATUS FOR DOCUMENT SETTING, FEEDING AND PROCESSING

BACKGROUND OF THE INVENTION

1. Field of the Invention

This invention relates to setting sheet materials, apparatus for feeding sheet materials, and image processing apparatus. And an image processing apparatus could be photocopier, facsimile machine, or printer, in which a sheet material is fed into an apparatus body to record images on the sheet material or to read images recorded on the sheet material, and apparatuses for setting sheet materials and for feeding sheet materials used for such an image processing apparatus.

2. Description of Related Art

Office machines such as photocopiers, facsimile machines, etc. are in wide use these days and on increased demand even for use in small offices and by individuals. Such users who cannot sacrifice a large space merely for office machines have a need for smaller machines from a viewpoint of saving space.

The installation area of an apparatus when a cassette is used for feeding sheet materials depends on the size of the cassette, or the maximum size of the sheet materials. To make the installation area of the apparatus smaller, apparatuses of an increased number have adopted a so-called ASF (Auto Sheet Feeder) system in which the sheet materials are fed sheet by sheet to the apparatus body where a stacking or setting tray on which sheet materials are set in a slant state is arranged at each rear end of the apparatuses. By this ASF system, the size of the apparatus in the front to back direction can be designed smaller than the maximum length of the sheet materials.

Meanwhile an apparatus is required to have a cover openable to form an opening such that a user can put his hand into the opening to work for replacement of cartridges and recovery from paper jamming. When the apparatus is made further smaller, distances between respective units such as the recording portion and the image reading portion come closer, and therefore, the cover is used as not only a mere cover but also a tray for sheets or the like, so that an auxiliary tray may be attached to the cover.

When made openable and closeable, the cover may interfere with other units. The ASF unit described above, though setting the sheet materials on the sheet material setting tray and rendering the top face of the sheet materials exposed outside the apparatus, is required to properly set the sheet materials without positional deviations as much as possible on the sheet material setting tray to obtain appropriate separation of the materials during the feeding operation. If the feeding operation is implemented while the sheet materials are not properly set, the apparatus induces a separation failure or oblique feeding upon incorrect engagement of the edge of the sheet material with the separation unit, and in the worst scenario, the sheet material may be jammed.

The ASF unit is a member disfavoring disorder of sheet materials that already set once, and therefore, disorder of sheet materials'bundle by a collision of the cover or an accessory of the cover such as an auxiliary tray when the cover is opened or closed impairs ability of separation during feeding of the apparatus. Moreover, when the cover is opened or closed, the auxiliary tray or the like may possibly hit the surface of the sheet materials.

One possible solution is to remove the accessory from the cover when the cover is opened or closed. In some case, however, the cover may not be removed when open or closed, and other functions may be lost by failure to put the accessory back or by lost of the accessory.

SUMMARY OF THE INVENTION

This invention is designed to solve the above problems, and it is an object of the invention to devise a sheet support structure preventable of mitigation of feeding performance and to provide apparatuses for setting sheet materials and for feeding sheet materials and an image processing apparatus using the apparatus or apparatuses.

A representative structure according to the invention to accomplish the foregoing object is an apparatus for feeding sheet materials in which stacked sheet materials are fed, including a sheet material supporting means for supporting sheet materials, a feeding means for feeding the sheet materials that are supported by the sheet material supported means, an openable cover member pivotal with respect to an apparatus body, an auxiliary member pivotably attached to the cover member, and a restricting means for restricting pivotal movement of the auxiliary member. The auxiliary member performs, when the cover member is made open, a united pivotal movement rendering the auxiliary member closer to the sheet material supporting means by pivotally moving as a united body with the cover member and a separation movement rendering the auxiliary member away from the sheet material supporting means upon restriction of the united pivotal movement by the restricting means.

With the structure above, even when the cover member is opened or closed to replace a cartridge or to recover a paper jamming, such work can be done without disturbing the stacked state of the sheet materials supported on the sheet material supporting means, thereby preventing the conveyance performance of the sheet materials from impaired, and thereby rendering the apparatus more reliable.

Since this invention is thus constituted, the auxiliary member does not operate to rub up the surface of the sheet materials supported by the sheet material supporting means when the cover member is made open and closed, thereby eliminating disorder of the sheet materials. Therefore, the set state of the sheet materials is maintained properly, and the apparatus is allowed to perform recovery of paper jamming and replacement of recording heads without diminishing the ability of separation conveyance of the recording paper. Moreover, because the auxiliary member is not necessarily removed when the cover member is opened or closed, the cover can not be lost.

Moreover, even during recovery from paper jamming while the recording cover is opened, a space is formed between the sheet material setting member and the auxiliary member, so that the recording material can be readily removed and added the sheet material setting member.

DETAILED DESCRIPTION OF PREFERRED EMBODIMENTS

Figure 1:
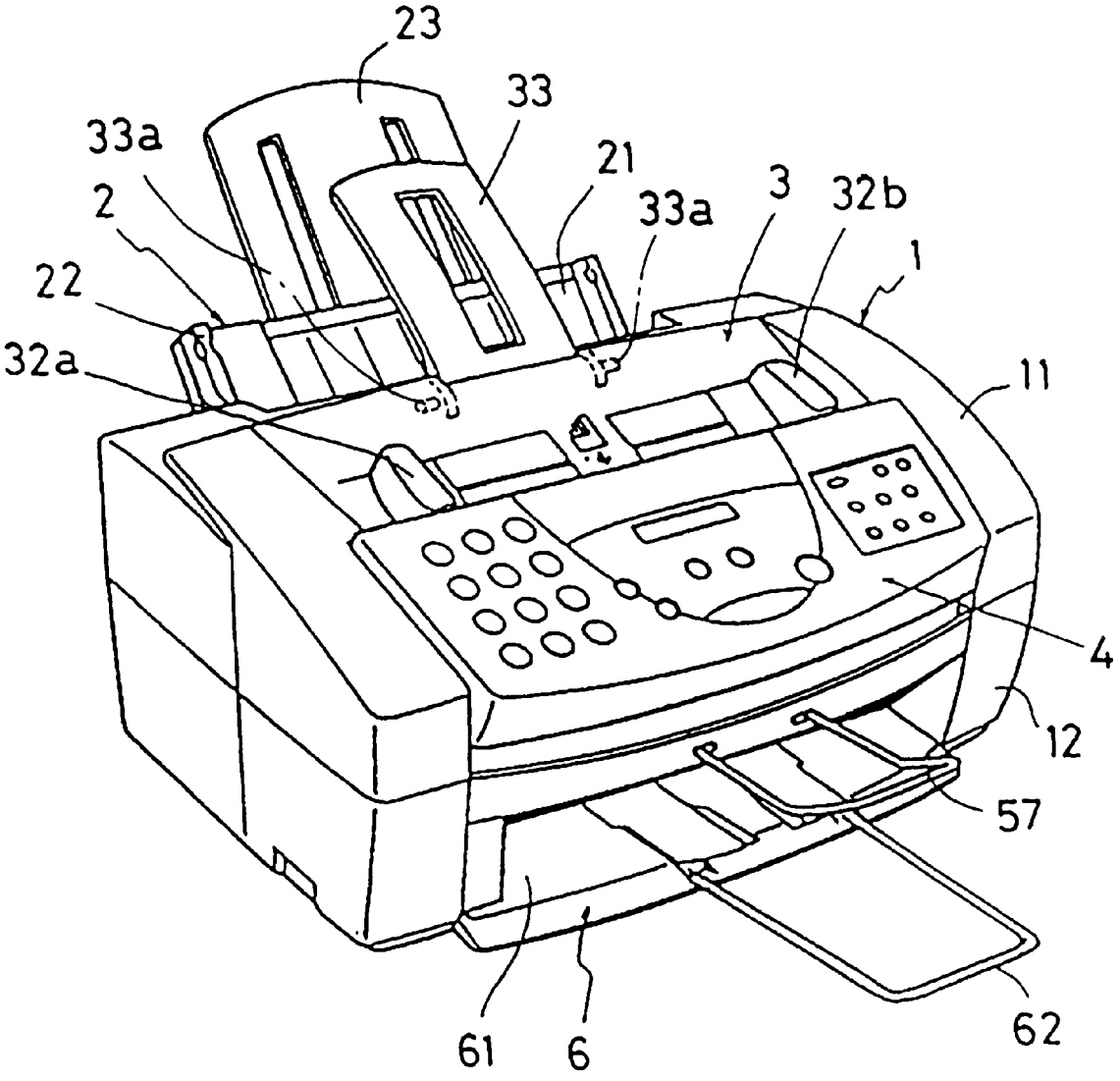
FIG. 1 is an illustration showing a facsimile machine according to a first embodiment of the invention.
Figure 2:
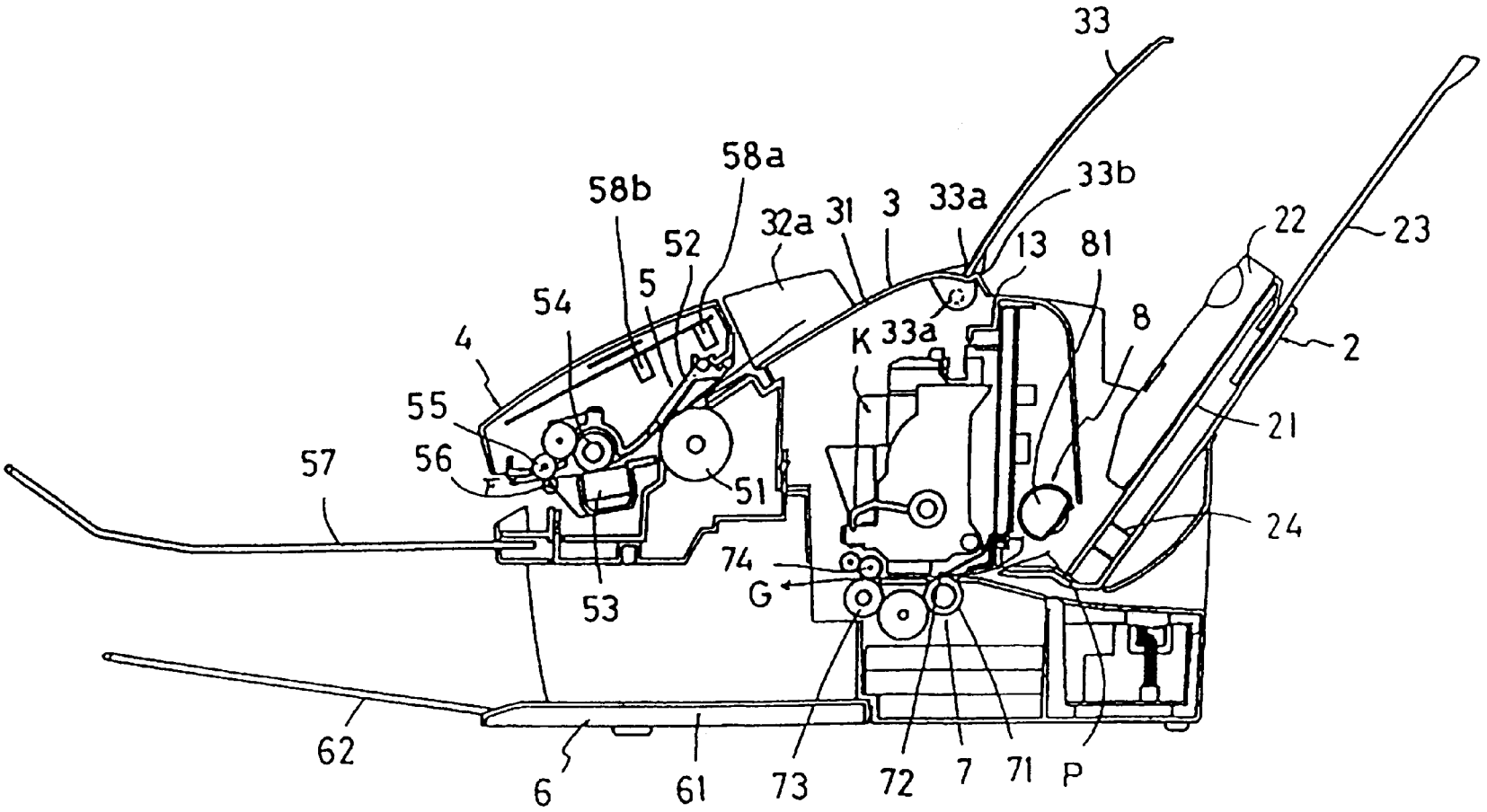
FIG. 2 is a cross-sectional side view showing the facsimile machine.

FIG. 1 is an illustration showing a facsimile machine according to a first embodiment of the invention, and FIG. 2 is a cross-sectional side view showing the facsimile machine. Here, we describe first the entire constitution of the facsimile machine and then a sheet material supporting structure of a sheet material feeding apparatus.

[Entire Constitution]

In FIGS. 1, 2, numeral 1 is a facsimile machine body or apparatus body to which this invention applies; numerals 11, 12 are upper and lower covers constituting housings of the machine, respectively. Numeral 2 is a recording paper setting tray unit, serving as sheet material supporting means, for setting recording sheet materials (hereinafter referred to as "recording paper") made of paper or plastic sheets.

Numeral 3 is a recording cover unit openable in respect to the apparatus body. By opening the recording cover unit 3, space needed for replacement of a recording head K shown by double-dotted chain line in FIG. 2 and space needed for recovery for paper jamming become available. The recording cover unit 3 also serves as a document setting tray for setting document sheet materials (hereinafter referred to as "documents") to be fed to a reading unit as described below.

Numeral 4 is a controller unit for controlling the facsimile machine; numeral 5 is the reading unit serving as a reading apparatus for reading the documents optically; numeral 7 is a recording unit made of an ink jet recording apparatus. The reading unit 5 and the recording unit 6 constitute an image processing means for reading images formed on the documents and to record images on the recording paper.

Numeral 6 is a recording paper delivery tray unit for setting the recording paper on which the images have been recorded by the recording unit 7; numeral 8 is a feeding unit constituting a feeding means for feeding the recording paper set on the recording paper setting tray sheet by sheet to the recording unit 7. Numeral K is the recording head detachable from the machine, incorporates an ink tank, and has a structure replaceable with a new one when ink runs out.

[Recording Structure]

Referring to FIG. 1, the flow of the recording paper and recording structure is described briefly. A route of the conveyance of the recording paper is shown by arrow G. In this embodiment, plain paper of a standard size as recording paper is used, and stacked plural paper sheets are contained in the recording paper setting tray unit 2.

Numeral 21 is an intermediate plate for setting the recording paper and is pivotal around the top end of the plate with respect to the recording paper setting tray unit 2. Numeral 24 is a compression spring for pushing the intermediate plate 21 to urge the recording paper set on the intermediate plate 21 in a direction such that the recording paper contacts with the feeding unit 8. Numeral 22 is a recording paper regulating slider and is slidable in a widthwise direction of the intermediate plate 21 with respect to the intermediate plate 21, thereby preventing the recording paper P from being fed obliquely with respect to the machine body 1 by regulating the sides of the recording paper. Numeral 23 is a recording paper auxiliary tray and is contained in the recording paper setting tray unit 2. The recording paper auxiliary tray 23 can extend the length of the recording paper setting tray unit 2 by pulling the recording paper auxiliary tray 23, thereby rendering the machine correspond to a larger recording paper such as of the legal size.

The recording paper P set in the recording paper setting tray 2 is conveyed to the recording unit 7 upon being picked-up by a feeding roller 81 and a separation nail, not shown. In the recording unit 7, the recording paper P is sandwiched by a conveyance roller 71 and a pinch roller 72 and carried. The recording head K disposed on a downstream side of the conveyance roller 71 makes recording on the recording paper P, which is sandwiched by a delivery roller 73 positioned on a downstream side of the recording head K and a spur 74 disposed opposingly to the delivery roller 73 and delivered onto the recording delivery tray unit 6 as to be stacked on the unit 6. Numeral 61 is a recording delivery tray for holding the recording paper that is recorded and delivered; numeral 62 is a recording delivery auxiliary tray detachably attached to the recording delivery tray 61; the recording delivery auxiliary tray 62 prevents the tips of the recording paper from dropping off from the machine.

It is to be noted that the recording apparatus of this embodiment uses an ink jet recording method in which the recording head sprays ink to make the recording. This recording method makes recording by flowing, in accordance with recording signals, a current through an electrothermal converter arranged in a matrix figure to form a recording head material, utilizing film boiling created in the ink caused by thermal energy from the converter, and spraying the ink through orifices by development and contraction of bubbles created in the ink. The spur 74 is formed as to have a smaller contact area with the recording paper P and as not to disturb the recorded images on the paper surface even if the spur 74 contacts with the paper surface after recording.

[Reading Structure]

The flow of the documents S and the reading structure is described. Arrow F shows the conveyance route of documents. The documents S are detected by a document existence sensor 58*a* by way of a document existence detection actuator for detecting whether the document, not shown, exists when one sheet or plural sheets of the documents S are set on the recording cover unit 3. Numeral 31 is a document setting tray serving as a cover member and mounted pivotably to the facsimile machine body 1 through a pivotal shaft 31*a*. Numerals 32*a*, 32*b* are sliders for documents, regulating sides of the documents according to sizes of the documents, and are formed as to be slidable with respect to the document setting tray 31.

Numeral 33 is a document auxiliary tray serving as an auxiliary member, which supports an end (upper end) of the documents S set on the document setting tray 31 and is set to have an optimum angle maintainable of separation of the documents S during the feeding performance. The document auxiliary tray 33 is pivotably attached to the document setting tray 31 through an axis 33*a*, and held as shown in FIG. 2 by means of a stopper portion.

With the reading unit 5, a separation roller 51 rotates by a stepping motor, not shown, which serves as a drive power source, when a start button, not shown, is pushed for transmission as well as copying by a user. The documents S are brought tangly to a nip portion between the separation roller 51 and a friction piece unit 52 disposed at a position opposing to the separation roller 51, separated at the nip portion sheet by sheet, and fed to the a contact sensor 53 for reading image information on the documents S. A document front and rear end detection actuator, not shown, is disposed between the separation roller 51 and the contact sensor 53 to detect the front and rear ends of the documents.

In FIG. 1, numeral 58*b* is a document front and rear end sensor for detecting front and rear ends of the documents through the document front and rear end detection actuator. The sensor 58*b* detects the front end of the documents S, and the separation roller 51 conveys the documents S in a timely manner so that the image information on the documents S is read accurately when the documents S reach the reading position of the contact sensor 53.

A conveyance roller 54 is disposed at a position opposing the contact sensor 53 so as to press the reading surface of the contact sensor 53, thereby preventing the documents S from floating from the contact sensor 53. The conveyance roller 54 conveys the documents S in a direction of arrow F upon receiving drive force from the stepping motor above.

While the contact sensor 53 reads the image data of the documents S, the document front and rear end sensor 58*b* detects the rear end of the documents. By rotating the delivery roller 55 based on this information, the delivery roller 55 and a delivery roller 56 disposed opposingly thereto sandwich the documents S and deliver the documents S onto the document delivery tray 57. It is to be noted that the document delivery tray 57 is constructed so that the tray can be pulled with respect to and contained in the machine body 1.

[Sheet Supporting Structure of a Sheet Material Feeding Apparatus]

Figure 3:
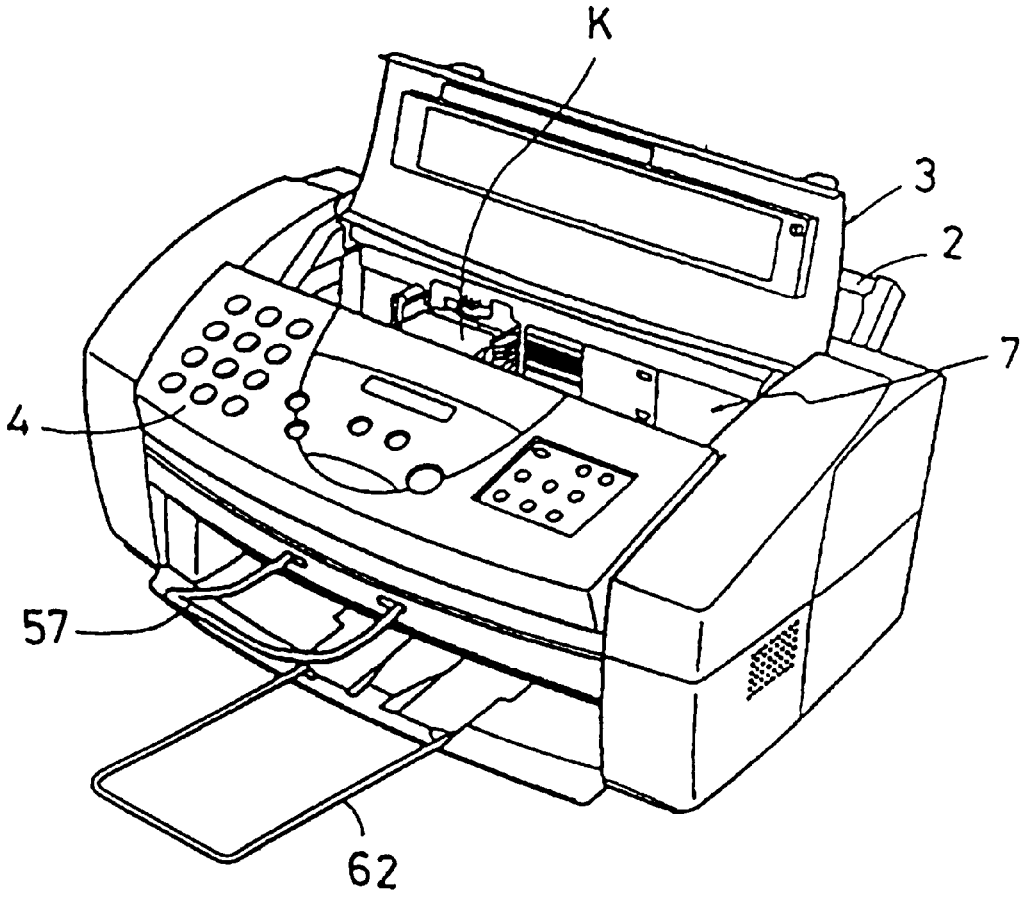
FIG. 3 is a perspective illustration showing the facsimile machine in a state that a document setting tray constituting a recording cover unit is opened.
Figure 4:
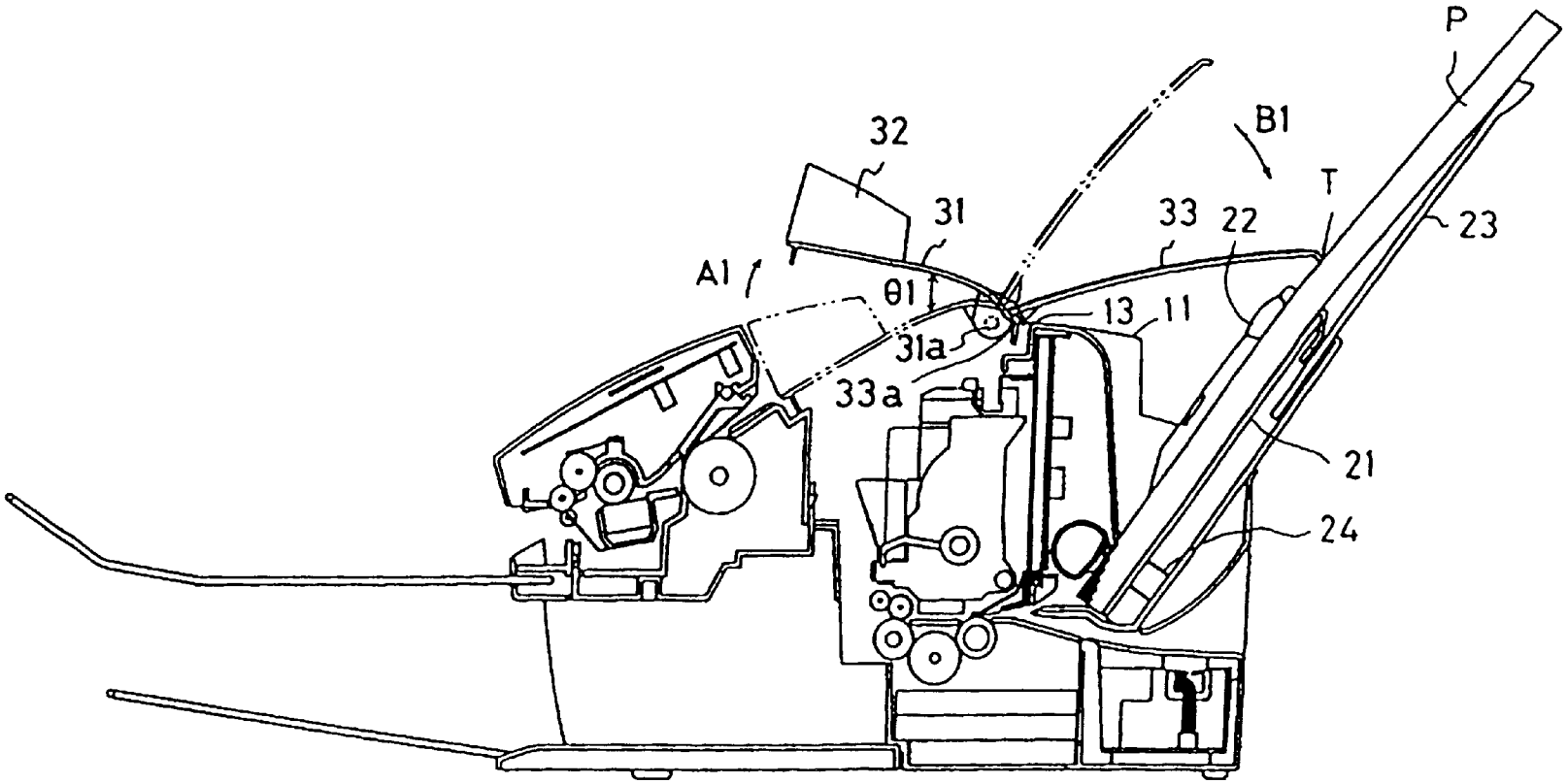
FIG. 4 is an illustration showing the facsimile machine in a state that the document setting tray and a document auxiliary tray rotate as a united body.
Figure 5:
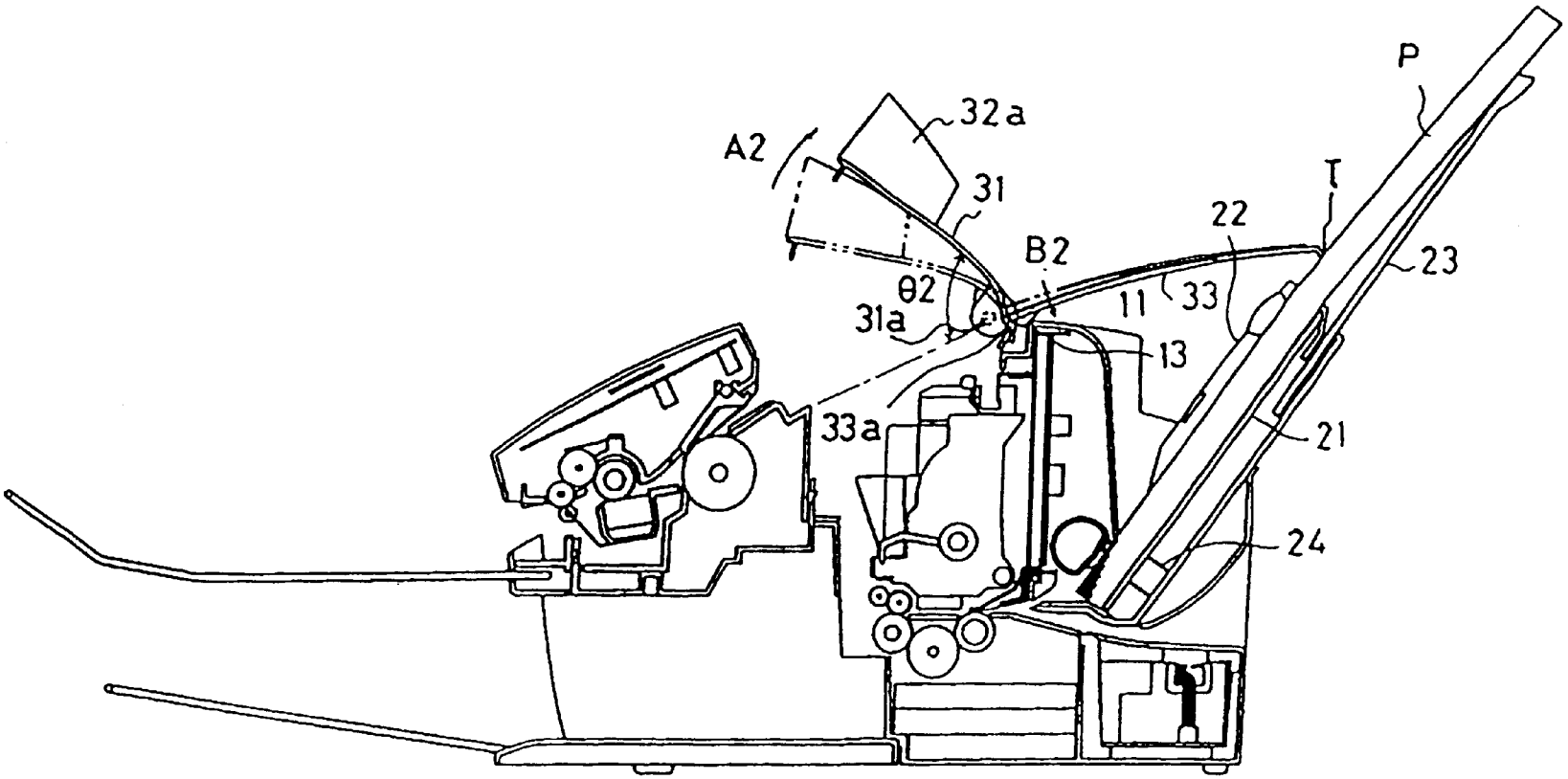
FIG. 5 is an illustration showing the facsimile machine in a state that a tip of the document auxiliary tray contacts with recording paper set on a recording paper setting tray and that the contact point does not move and is independent of pivotal movement of the document setting tray.
Figure 6:
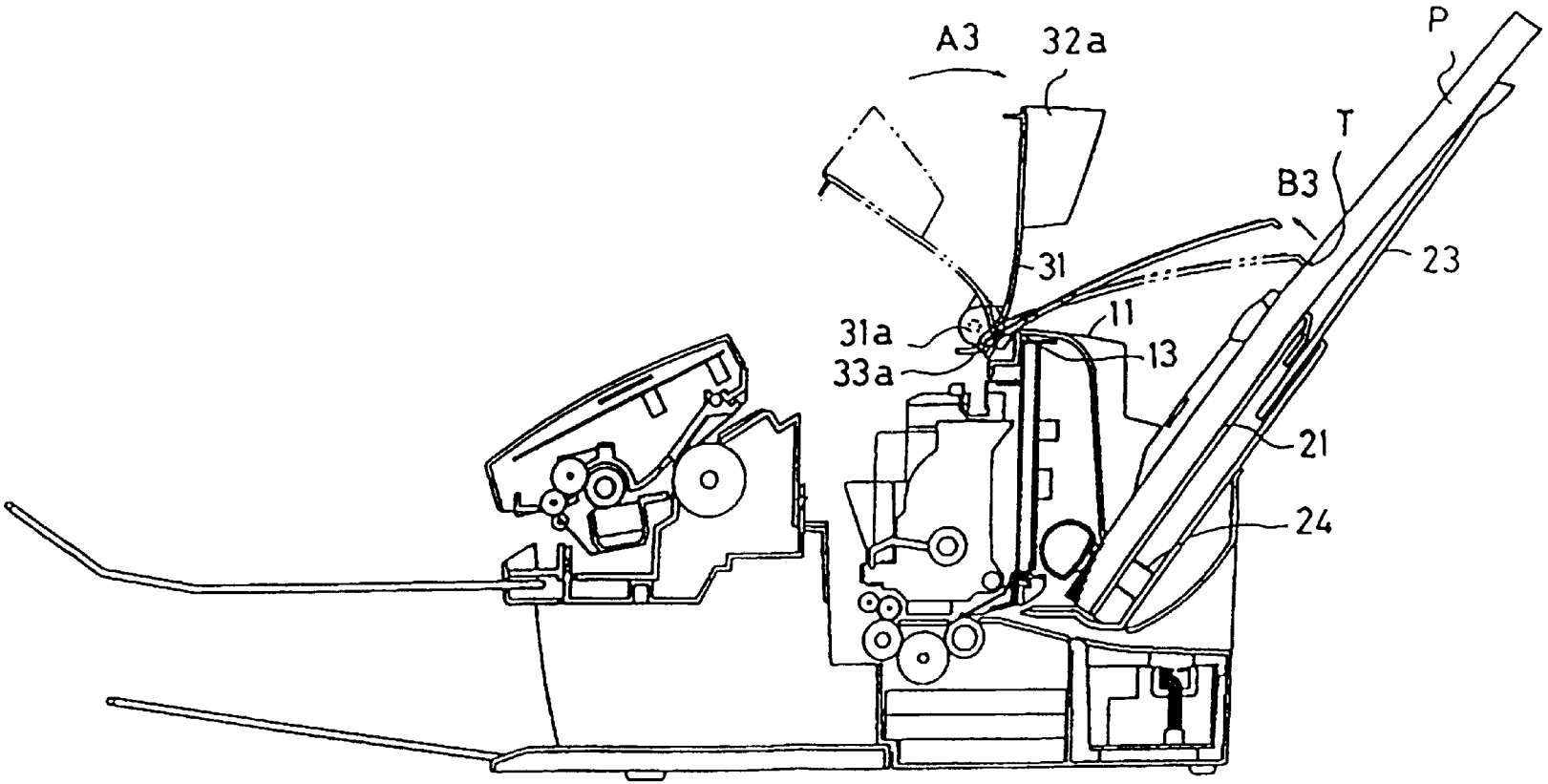
FIG. 6 is an illustration showing the facsimile machine in a state that the tip of the document auxiliary tray separates from the recording paper set on the recording paper setting tray.

Next, referring to FIGS. 3 to 6, operation when the recording cover unit 3 is opened and closed is described in detail. FIG. 3 is a perspective illustration showing a state that the document setting tray 31 constituting the recording cover unit 3 is made open; FIGS. 4 to 6 are illustrations showing states while the document setting tray 31 is made open and closed.

When the recording paper is recovered from paper jamming or when the recording head K is replaced, the user opens the document setting tray 31 and does necessary work upon exposing the recording head K. If the documents are placed on the recording cover unit, the cover is opened after the documents are removed, and then the user does the above work. When the document setting tray 31 is pivotally moved to open and close, this embodiment has three angle regions: an angle region for a united pivotal movement in which the document auxiliary tray 33 attached to the document setting tray 31 pivotally moves in uneven with the document setting tray 31 to come close to the recording paper setting tray 2; an angle region for stopping pivotal movement of the document auxiliary tray 33 in which the end of the document auxiliary tray 33 contacts with the recording paper P set on the recording paper setting tray 2 and in which the contacting point is independent of the pivotal movement of the document setting tray 31 and is immobilized; and an angle region for separation operation in which the document auxiliary tray 33 moves away from the recording paper P set on the recording paper setting tray 2 according to release of the document setting tray 31.

Referring to FIGS. 4 to 6, operation of the cover from a state that the cover is closed and to a state that the cover is completely open is described.

FIG. 4 is an illustration showing a state that the document setting tray 31 and the document auxiliary tray 33 moves pivotally in a manner of the united body. The document setting tray and the document auxiliary tray which are depicted by a double-dotted chain line shown in FIG. 4 indicate a closed state with respect to the machine body 1. The document setting tray 31 is formed to be openable with respect to the machine body 1 by moving pivotally around the pivotal shaft 31*a* as a fulcrum. The document setting tray 31 depicted by a solid line shows its open state that the tray 31 is opened in a direction of arrow Al. At that time, the auxiliary tray 33 moves pivotally in a united body manner (united pivotal movement operation) together with the document setting tray 31. As an opened angle is widened from the state that the document setting tray 31 is closed, the tip of the document auxiliary tray 33 contacts with a surface of the recording paper P set on the recording paper setting tray unit 2. Point T in FIG. 4 is a contact point between the document auxiliary tray 33 and the recording paper P. The opened angle at that time of the document setting tray 31 is defined as θ1.

FIG. 5 is an illustration showing a state that the tip of the document auxiliary tray 33 contacts at point T with the recording paper P set on the recording paper setting tray 2 and that the contact point is independent of the pivotal movement of the document setting tray 31 and does not travel. The document setting tray and the document auxiliary tray which are depicted by a double-dotted chain line shown in FIG. 5 represent a state that the opened angle θ1 is made in FIG. 4 (a state shown by the solid line in FIG. 4).

When the document setting tray 31 is opened in a direction of arrow A2 from a state of the document setting tray 31 depicted by the- double-dotted chain line in FIG. 5, the contact point T restricts the united pivotal movement of the document auxiliary tray 33 with the document setting tray 31, and even if the document setting tray 31 is moved pivotally, the auxiliary tray 33 does not move in a manner of the united body and remains unmoved (pivotal movement stopping operation). When the document setting tray 31 is further made open, the axis 33*a* of the document auxiliary tray 33 moves downward because the axis 33*a* is located at a position eccentric to the pivotal shaft 31*a*, and therefore, the document auxiliary tray 33 moves in a direction of arrow B2 around point T as a fulcrum.

Numeral 13 is a restricting member serving as a restricting means for restricting the movement of the document auxiliary tray 33 and is formed in a united body with the upper cover 11. As the opened angle of the document setting tray 31 is widened, the document auxiliary tray 33 contacts with the restricting member 13, which stops the movement of the document auxiliary tray 33 in a direction of B2. The opened angle at that time is defined as θ2.

FIG. 6 is an illustration showing a state that the tip of the document auxiliary tray 33 is separated from the recording paper P set on the recording paper setting tray 2. The document setting tray and the document auxiliary tray which are depicted by a double-dotted chain line shown in FIG. 6 represent a state that the opened angle θ2 is made in FIG. 5 (a state shown by the solid line in FIG. 5). If the document setting tray 31 is further made open in a direction of arrow A3 from a state of the document setting tray 31 depicted by the double-dotted chain line in FIG. 6, the axis 33*a* of the document auxiliary tray 33 moves left downward. At that time, a projection 33*b* of the document auxiliary tray 33 is in contact with the restricting member 13 and restricted from moving, and therefore, the pivotal center of the document auxiliary tray 33 moves from the pivotal shaft 31*a* to the axis 33*a*. Because the pivotal center of the document setting tray 31 (or the pivotal shaft 31*a*) does not coincide with the pivotal center of the document auxiliary tray 33 (or the axis 33*a*), the document auxiliary tray 33 is pulled downward and further moves pivotally in a direction in opposition to the pivotal movement direction of the document setting tray 33, or a direction of arrow B3 by the guide of the restricting member 13. The document auxiliary tray 33 moves away from the recording paper P (separation operation).

In sum, this apparatus has the three operational regions for performing the operations below according to the opened angle θ of the document setting tray 31. That is, (1) at a region that θ is zero or greater and is θ1 or less, the apparatus performs the united pivotal movement operation in which the document setting tray 31 and the document auxiliary tray 33 move pivotally as a united body; at that time, both trays 31, 33 pivotally move together around the pivotal shaft 31 as a center;

(2) at a region that θ is θ1 or greater and is θ2 or less, the apparatus performs the pivotal movement stopping operation in which the document auxiliary tray 33 contacts with the recording paper P, and the contact point is independ of the pivotal movement of the document setting tray 31 and is immobilized;

(3) at a region that θ is θ2 or greater, the apparatus performs the separation operation in which the document auxiliary tray 33 moves away from the recording paper P until when the document setting tray is made fully open; at that time, the document setting tray 31 moves pivotally around the pivotal shaft 31*a* as a center whereas the document auxiliary tray 33 moves pivotally around the axis 33*a* as a center.

It is to be noted that when the document setting tray 31 is made closed, the apparatus operates in the reverse way to the above movements.

Since the document auxiliary tray 33 is formed to move in a manner described above with respect to open and closed operation of the document setting tray 31 which also serves as a recording cover, the document auxiliary tray 33 does not operate to rub up the surface of the recording paper P when the recording cover is made open and closed, thereby eliminating disorder of the bundled recording paper. Therefore, the apparatus allows to perform recovery of paper jamming and replacement of recording heads without diminishing ability of separation conveyance of the recording paper. Moreover, even during recovery from paper jamming while the recording cover is opened, a space is formed between the intermediate plate 21 and the auxiliary tray 33, so that the recording paper can be readily removed and added to the tray.

[Second Embodiment]

In the first embodiment thus described, it is exemplified that the document auxiliary tray 33 serving as an auxiliary member performs the united pivotal movement operation, the pivotal movement stopping operation, and the separation operation, when the document setting tray 31 is made open. As a second embodiment, referring to FIGS. 7 to 9, an example is described in which an auxiliary member performs united pivotal movement operation and separation operation when the cover member is made opened.

Figure 7:
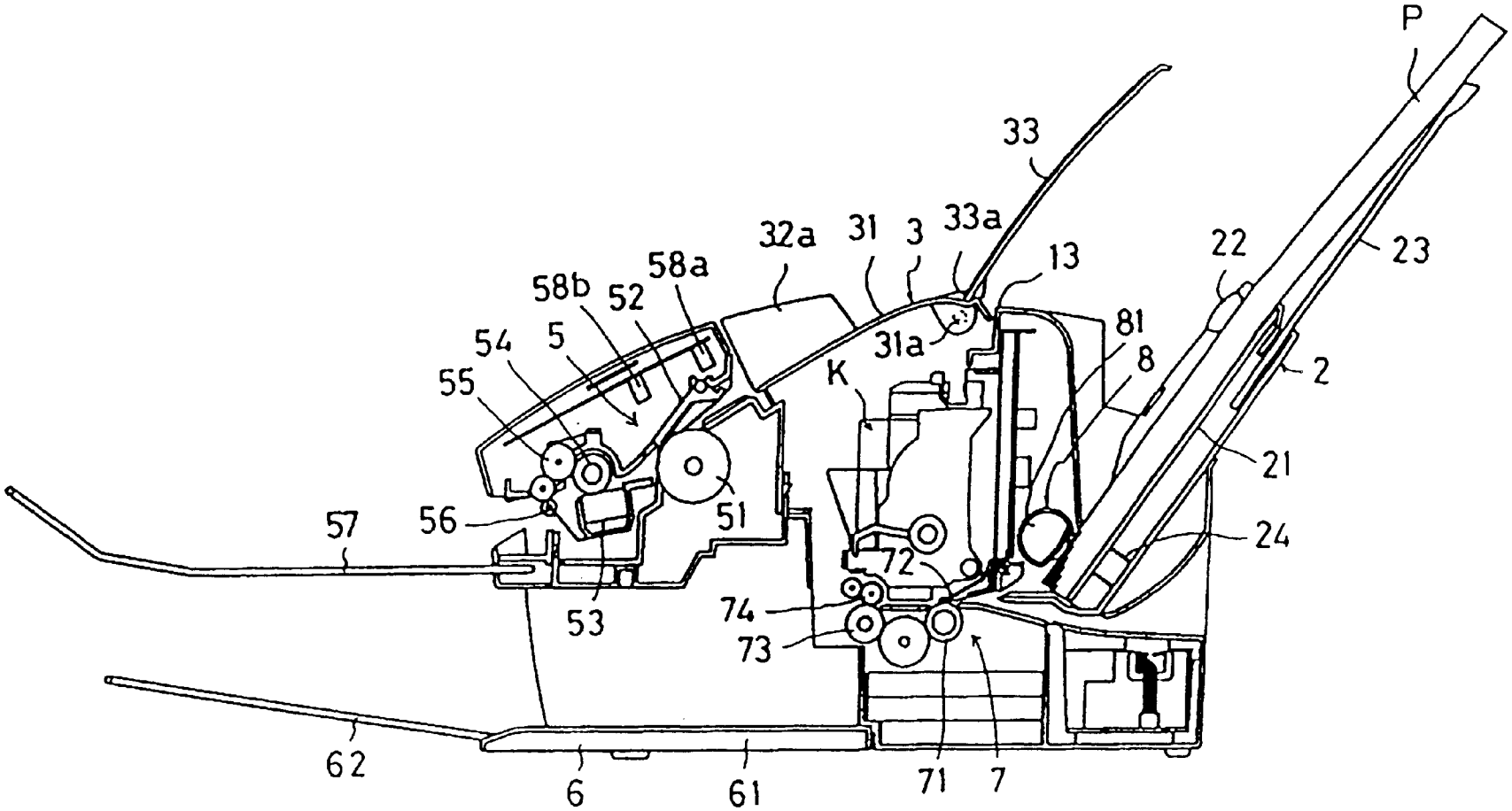
FIG. 7 is a cross-sectional view showing an image forming apparatus according to the second embodiment.
Figure 8:
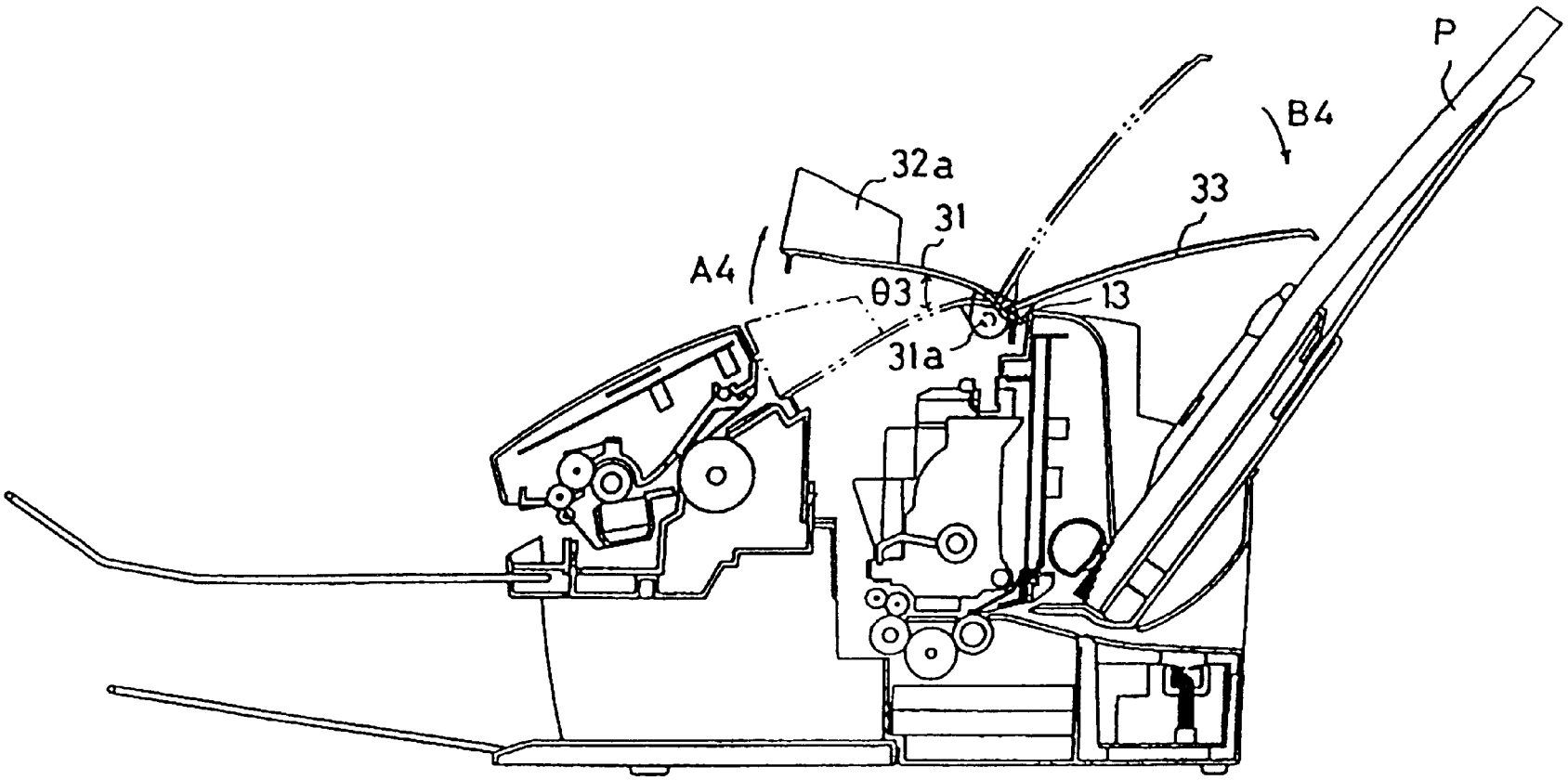
FIG. 8 is an illustration showing the apparatus in a state that the document setting tray and a document auxiliary tray rotate as a united body.
Figure 9:
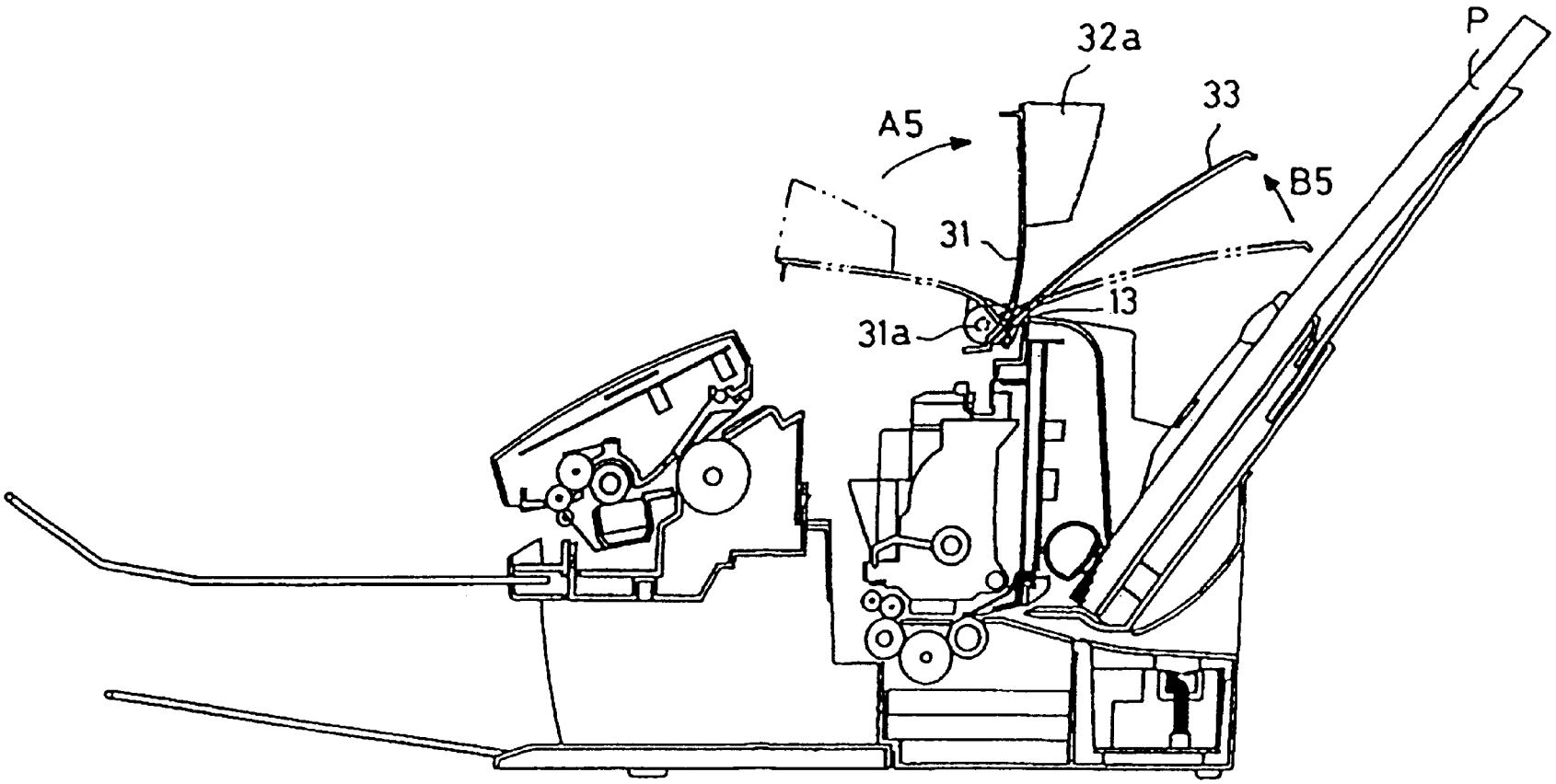
FIG. 9 is an illustration showing the apparatus in a state that a tip of the document auxiliary tray is going away from the recording paper set on the recording paper setting tray.

It is to be noted that FIG. 7 is an illustration showing an image forming apparatus according to the second embodiment; FIGS. 8, 9 show the apparatus in states while the document setting tray 31 serving as a recording tray is made open and closed. In those figures, members having the same function as those in the first embodiment are assigned with the same reference numbers to omit duplicated descriptions. In this embodiment, the restricting member 13 and the document auxiliary tray 33 are disposed as to be closer to each other, and therefore, both come in contact with each other at a shallower pivotal angle than that of the image forming apparatus of the first embodiment.

FIG. 8 is an illustration showing a state that the document setting tray 31 and the document auxiliary tray 33 pivotally move as a united body. The document setting tray and the document auxiliary tray depicted by a double-dotted chain line indicate a closed state with respect to the apparatus body 1. The document setting tray 31 is arranged openable around the pivotal shaft 31*a* as a center with respect to the apparatus body 1, and the document setting tray 31 depicted by a solid line shows a state that the tray 31 is made open in a direction of arrow A4. At that time, the auxiliary tray 33 moves pivotally in a direction of arrow B4 in a united body with the document setting tray 31 (united pivotal movement operation). As the opened angle of the document setting tray is made wider, the document auxiliary tray 33 contacts with the restricting member 13 before the tip of the auxiliary tray 33 contacts with the recording paper P, so that the united pivotal movement of the document auxiliary tray 33 and the recording cover 3 is stopped. The opened angle at that time is defined as θ3.

FIG. 9 is an illustration showing a state that the tip of the document auxiliary tray 33 is going away from the recording paper P set on the recording paper setting tray 2. The document setting tray and the document auxiliary tray which are depicted by a double-dotted chain line shown in FIG. 9 represent a state that the opened angle θ3 is made in FIG. 8 (a state shown by the solid line in FIG. 8)

If the document setting tray 31 is further made open in a direction of arrow A5 from a state of the document setting tray 31 depicted by the double-dotted chain line in FIG. 9, the axis 33*a* of the document auxiliary tray 33 moves downward along a circumference whose center is the pivotal shaft 31*a*. That is, the lower end of the document auxiliary tray 33 at that time is guided by the restricting member 13 and pulled down. The document auxiliary tray 33 moves to separate in a direction of arrow B5 by pivotally moving around the axis 33*a* (separation operation).

As described above, this apparatus has the two operational regions for performing the operations below according to the opened angle θ of the document setting tray 31. That is, (1) at a region that e is zero or greater and is θ3 or less, the apparatus performs the united pivotal movement operation in which the document setting tray 31 and the document auxiliary tray 33 move pivotally as a united body; at that time, both trays 31, 33 pivotally move together around the pivotal shaft 31 as a center, in the same way as in the first embodiment;

(2) at a region that θ is θ3 or greater, the apparatus performs the separation operation in which the document auxiliary tray 33 moves away from the recording paper P until when the document setting tray is made fully open; at that time, the document setting tray 31 moves pivotally around the pivotal shaft 31*a* as a center whereas the document auxiliary tray 33 moves pivotally around the axis 33*a* as a center.

It is to be noted that when the document setting tray 31 is made closed, the apparatus operates in the reverse way to the above movements.

Since the document auxiliary tray 33 is formed to move in a manner described above with respect to open and closed operation of the document setting tray 31, the apparatus allows to perform recovery of paper jamming and replacement of recording heads without diminishing ability of separation conveyance of the recording paper, as well as the first embodiment described above.

[Other embodiments]

Although in the embodiments described above, examples is described in which this invention applies to the facsimile machine having both of the reading apparatus and the recording apparatus as an image processing means, the image processing apparatus according to the invention is applicable to a printer having only a recording apparatus as image processing means and to an image scanner or image reader having only a reader.

Accordingly, although in the embodiments described above the document setting tray 31 as a cover member for supporting and setting the documents to be fed to the reading apparatus is exemplified, a document delivery portion for supporting documents delivered after read at the reading apparatus may be used as a cover member, and also, a recording paper delivery portion for supporting the recording paper delivered after recorded at the recording apparatus may be used as well.

The cover member and auxiliary member can be constituted openable as mere lids of the apparatus and may not always support the sheet materials.

What is claimed is:

1. An apparatus for setting sheet materials comprising:

a sheet material setting member pivotably supported by a sheet material processing apparatus for pivotable movement;

an auxiliary member for enlarging a sheet material setting area, said auxiliary member pivotably supported by a supported end of the sheet material setting member in a manner eccentric to the sheet material setting member and for pivotable movement coincident with the pivotable movement of the sheet material setting member; and a restricting member for restricting the pivotal movement of the auxiliary member at an intermediate point through the pivotal movement of the auxiliary member, wherein when the pivotal movement of the auxiliary member is restricted at the intermediate point by said restricting member, the auxiliary member moves in a direction reverse to the pivotal movement direction of the sheet material setting member.

2. An apparatus for setting sheet materials comprising:

a sheet material setting member pivotably supported by a sheet material processing apparatus;

an auxiliary member enlarging a sheet material setting area, pivotably supported by the sheet material setting member; and restricting means for restricting pivotal movement of the auxiliary member, wherein the auxiliary member is supported so as to pivotally move as a united body with the sheet material setting member when the sheet material setting members starts to move pivotally and to pivotally move in a direction reverse to the direction of pivotable movement of the sheet material setting member.

3. The apparatus for setting sheet materials according to claim 2, wherein the sheet material setting member and the auxiliary member are supported in a manner such that a pivotal center of the sheet material setting member is made eccentric to a pivotal center of the auxiliary member.

4. The apparatus for setting sheet materials according to claim 1 or 3, wherein the sheet material processing apparatus has a recording means for making records on sheet materials and a reading means for reading documents, and wherein the sheet material setting member is a tray.

5. The apparatus for setting sheet materials according to claim 4, wherein in a pivotal movement direction of the tray, the sheet tray is arranged to accommodate recording sheets.

6. The apparatus for setting sheet materials according to claim 1 or 3, wherein the sheet material setting member is a tray setting documents on the tray.

7. The apparatus for setting sheet materials according to claim 6, wherein the tray also serves as a cover of the sheet material processing apparatus.

8. The apparatus for setting sheet materials according to claim 7, wherein the sheet material processing apparatus is a document reader, and documents on the tray are conveyed by a feeding means to the document reader.

9. An apparatus for feeding sheet materials comprising:

sheet material supporting means for supporting sheet materials;

feeding means for feeding the sheet materials supported by the sheet material supporting means;

a cover member openable upon pivotable movement of the cover member;

an auxiliary member pivotably attached at an end to the cover member and having a free end opposite to the attached end; and restricting means for restricting the pivotal movement of the auxiliary member, wherein the auxiliary member pivotally moves in union with the cover member to bring the free end of the auxiliary member closer to the sheet material supporting means when the cover member is moved toward an opened position, and wherein the auxiliary member is restricted from said pivotal movement by the restricting means and caused to move in a manner bringing the free end of the auxiliary member away from the sheet material supporting means when the cover member is opened beyond a predetermined amount.

10. The apparatus for feeding sheet materials according to claim 9, wherein a pivotal center of the cover member and a pivotal center of the auxiliary member are eccentric to each other.

11. An image processing apparatus comprising:

image processing means for processing sheet materials;

sheet material supporting means for supporting the sheet materials;

feeding means for feeding the sheet materials supported by the sheet material supporting means;

a cover member openable upon pivotal movement of the cover member;

an auxiliary member pivotably attached at an end to the cover member and having a free end opposite to the attached end; and restricting means for restricting the pivotal movement of the auxiliary member, wherein the auxiliary member pivotally moves in union with the cover member to bring the free of the auxiliary member closer to the sheet material supporting means when the cover member is moved toward an opened position, and wherein the auxiliary member is restricted from said pivotal movement by the restricting means and caused to move in a manner bringing the free end of the auxiliary member away from the sheet material supporting means when the cover member is opened beyond a predetermined amount.

12. The image processing apparatus according to claim 11, wherein the image processing means is a recording apparatus for recording images on recording sheet materials, wherein the cover member is a member supporting a part of the document sheet materials to be fed to a reading apparatus, and wherein the auxiliary member is a member supporting the other part of the document sheet materials that are supported by the cover member.

13. The image processing apparatus according to claim 12, wherein the sheet material supporting means is a setting tray of a type extending in a substantially vertical direction; the fed sheet materials are conveyed in a substantially horizontal direction by passing through a recording portion; the cover member is arranged over the recording portion in extending in a direction intersecting with the setting tray and is capable of setting, on the cover member, documents to be read; the auxiliary member is pivotably supported on the cover member at an end on a side of the setting tray; documents set on the cover member and the auxiliary member are conveyed in a direction along a conveyance direction of the sheet materials.

* * * * *

UNITED STATES PATENT AND TRADEMARK OFFICE

CERTIFICATE OF CORRECTION

PATENT NO. : 6,113,093

DATED : September 5, 2000

INVENTOR(S): KAZUYUKI MORINAGA, ET AL.

It is certified that error appears in the above-identified patent and that said Letters Patent is hereby corrected as shown below:

COLUMN 1:
Line 58, "materials'bundle" should read --materials' bundle--; and
Line 66, "case," should read --cases,--.

COLUMN 2:
Line 2, "lost" should read --loss--; and
Line 52, "added" should read --added to--.

COLUMN 7:
Line 25, "independ" should read --independent--.

COLUMN 8:
Line 48, "e" should read --θ--.

COLUMN 9:
Line 8, "is" should read --are--.

UNITED STATES PATENT AND TRADEMARK OFFICE

CERTIFICATE OF CORRECTION

PATENT NO. : 6,113,093

DATED : September 5, 2000

INVENTOR(S): KAZUYUKI MORINAGA, ET AL.

It is certified that error appears in the above-identified patent and that said Letters Patent is hereby corrected as shown below:

COLUMN 10:
Line 59, "free" should read --free end--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*